United States Patent [19]

Heidtmann

[11] Patent Number: 4,953,488

[45] Date of Patent: Sep. 4, 1990

[54] BOAT CARROUSEL

[76] Inventor: Heinrich Heidtmann, RR 6 Box 11500, Rio Piedras, P.R., 00928

[21] Appl. No.: 223,939

[22] Filed: Oct. 25, 1988

[51] Int. Cl.[5] ..... B63B 35/44

[52] U.S. Cl. ..... 114/44; 405/3; 414/283; 414/331

[58] Field of Search ..... 114/44; 405/1-3; 254/45, 89 R, 90; 414/597, 609-611, 630, 662, 331, 787, 233, 242, 243, 246, 253, 259-261, 263, 267, 281-283

[56] References Cited

U.S. PATENT DOCUMENTS

| | | | |
|---|---|---|---|
| 2,687,814 | 8/1954 | Romick | 405/3 |
| 3,101,144 | 8/1963 | Hurst | 405/1 |
| 3,287,921 | 11/1966 | Wilson | 405/3 |
| 3,332,248 | 7/1967 | Burnett | 114/44 |
| 3,378,151 | 4/1968 | Salloum | 414/233 |
| 3,395,815 | 7/1968 | Johnson | 414/263 |
| 3,554,391 | 1/1971 | Goodell | 414/331 |
| 4,023,687 | 5/1977 | Salloum | 414/263 |
| 4,108,322 | 8/1978 | Kochanneck | 414/263 |
| 4,678,366 | 7/1987 | Williamson | 405/3 |
| 4,726,316 | 2/1988 | Bruns | 414/263 |

*Primary Examiner*—Joseph F. Peters, Jr.
*Assistant Examiner*—Clifford T. Bartz
*Attorney, Agent, or Firm*—Scrivener and Clarke

[57] ABSTRACT

A storage facility for units, such as boats, consists of a multi-story rotatable tower having radial storage region opening to exterior of the tower, and an elevator tower fixed adjacent the exterior of the tower. The elevator tower includes a lift car having fingers movable beneath a unit to be lifted and also movable substantially radially from a retracted position to an extended position enabling units to be inserted into or removed from the storage regions and lowered to or raised from a loading/unloading station at the base of the lift tower.

5 Claims, 7 Drawing Sheets

BOAT CARROUSEL

This invention relates to storage facilities and more particularly to a multi-storied storage facility including a rotatable storage tower and a fixed lift tower external to the storage tower.

Though the present invention is suitable to the storing of any appropriate movable unit, it will be described primarily as it pertains to the storing of boats, particularly smaller boats powered by outboard motors or the like, and often referred to as "runabouts", suited to water skiing and other types of water related recreation. There is now in many areas a vast profusion of such power boats constructed of non-wood material such as fiberglass, not subject to change upon drying but which cannot conveniently be left in the water not only due to lack of mooring space but also, if stored in water, such boats are subject to fouling by marine growth which can only be controlled by expensive anti-fouling coatings which can also be toxic to desirable marine life. Heretofore, as a solution to these problems, special fork lift trucks have been provided to pick-up boats and transfer them to mutli-level frame structures having a series of side-by-side storage areas into or out of which the boats are moved by the fork lift truck, it being understood that the truck has exceptionally high guide posts for the lift fingers which in turn are exaggeratedly long in order to provide adequate support for the boats. The problem with such a storage system is that the storage structure, being linear, occupies a great deal of space and since this space must be near the water, it is prohibitively expensive and is becoming increasingly more so as the small amount of water-front or near-waterfront property is acquired for development and the like.

The object of the present invention is to provide an improved storage facility which is especially suited, though not exclusively, to the storage of boats.

It is a more specific object of the invention to provide an improved storage facility which makes a minimum demand for linear footage by being in the form of a cylindrical, multi-storied rotatable tower having storage regions open to the exterior of the tower to receive for storage units lifted thereto by elevator means exterior to the storage tower.

These and other objects will become apparent as the following detailed description is read in conjunction with the accompanying drawings wherein.

Figure 1:
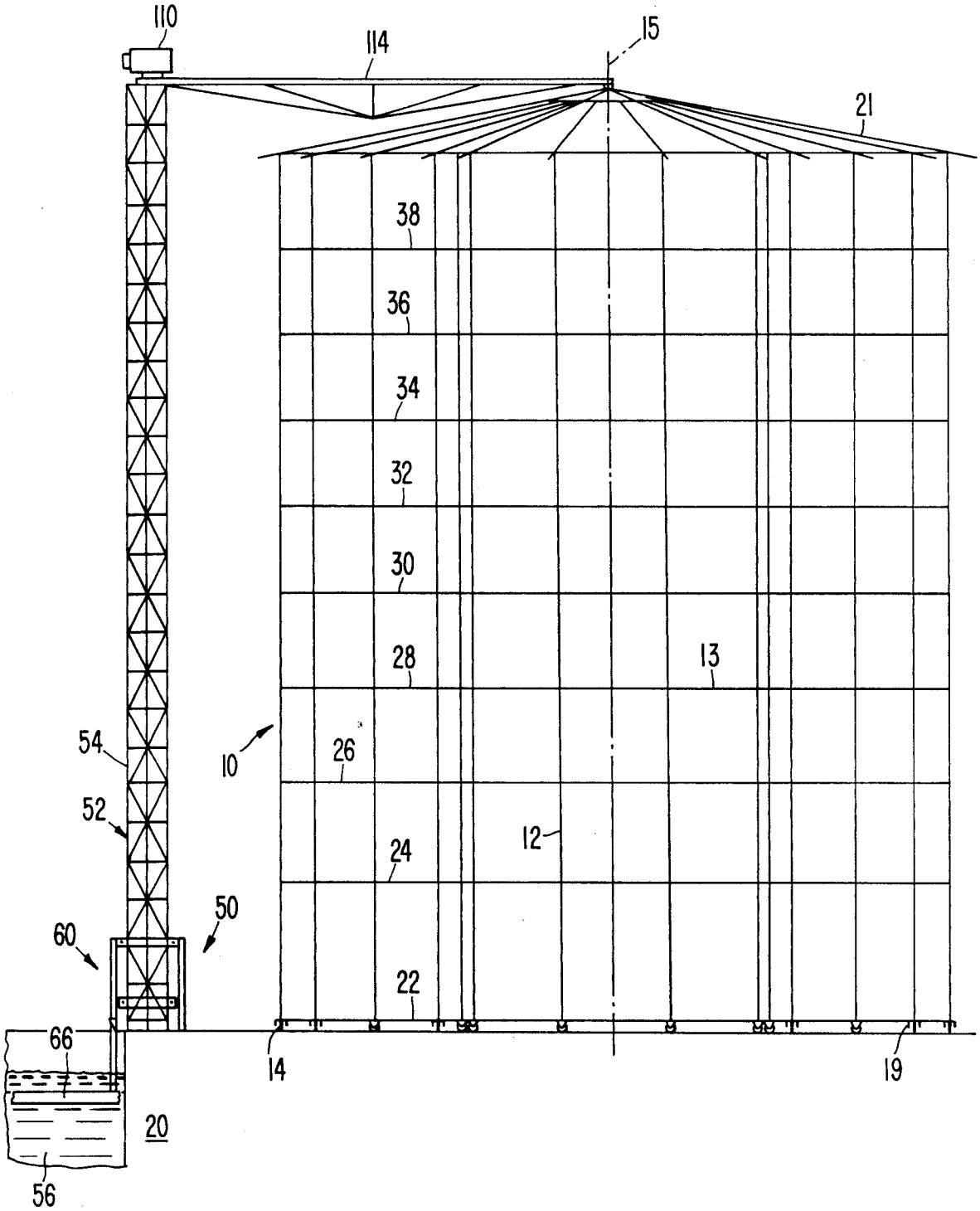
FIG. 1 is vertical side elevational view of the invention as adapted for the storage of boats.
Figure 2:
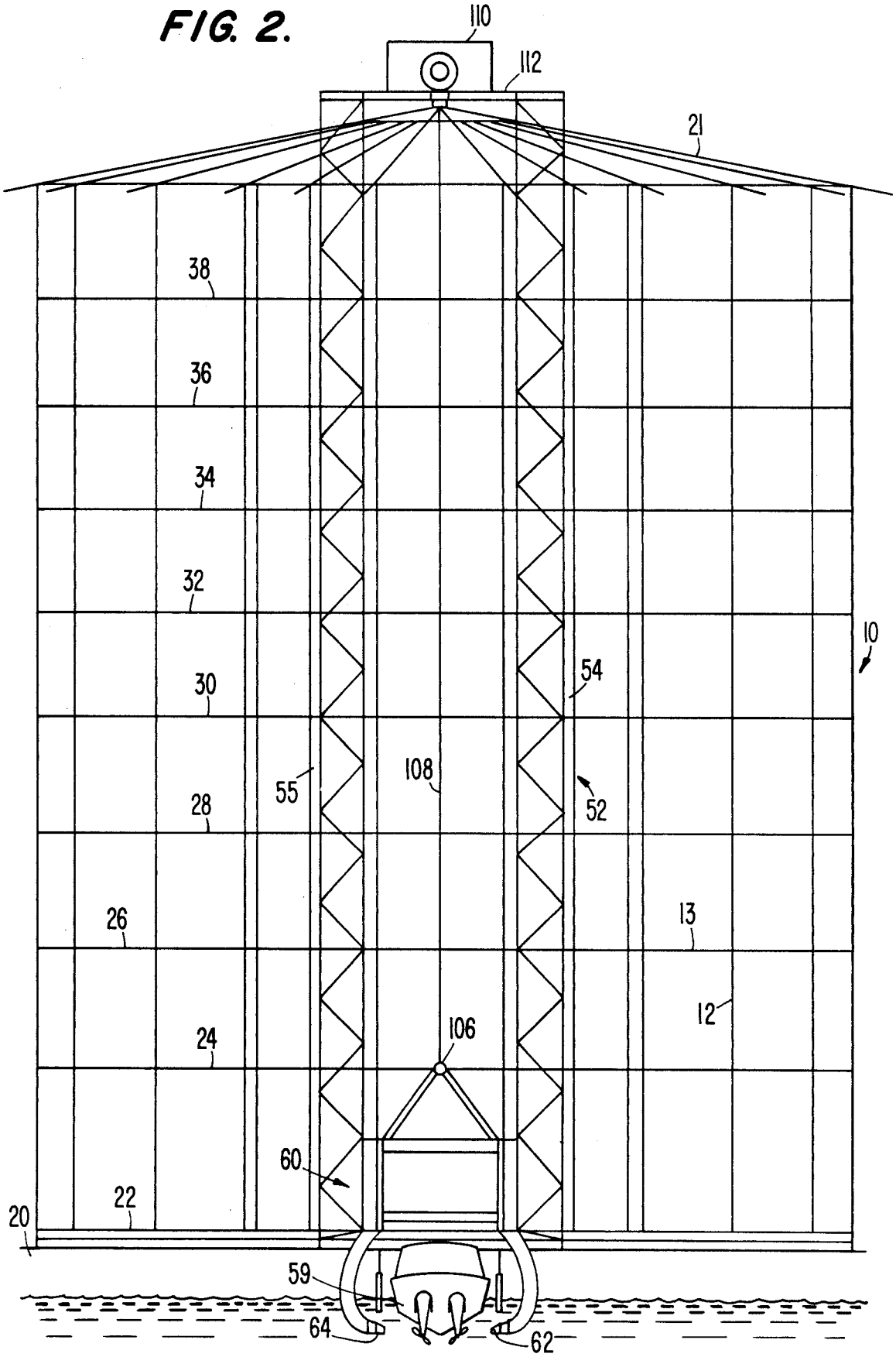
FIG. 2 is a front elevational view thereof.
Figure 3:
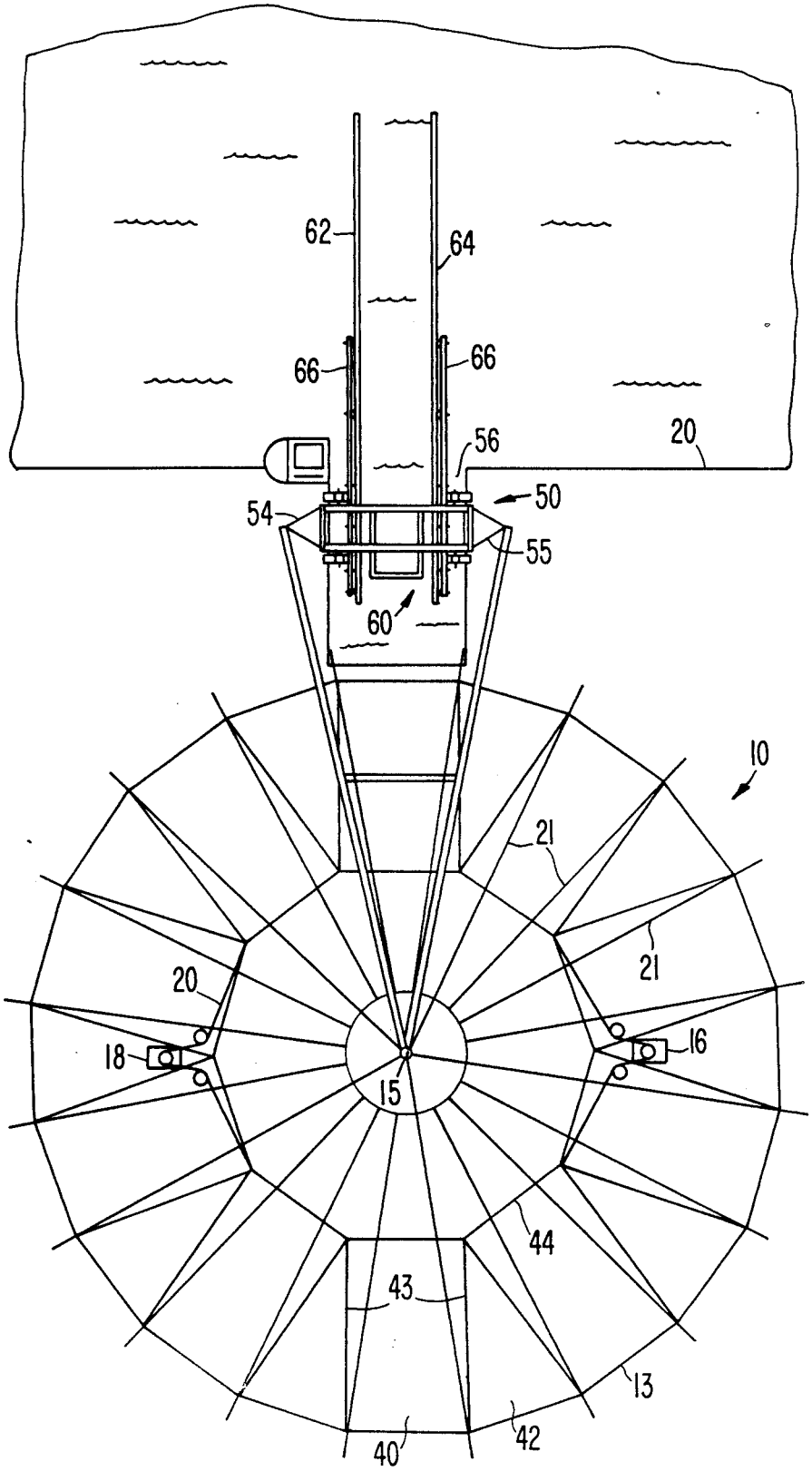
FIG. 3 is a top plan, somewhat schematic, view of the invention.

Referring now to the drawings and particularly FIGS. 1, 2 and 3, 10 designates a cylindrical storage tower defined by vertical and horizontal frame members 12, 13 connected together to form a rotatable structure mounted on wheels 14 for rotation about a vertical axis 15 by way of reversible motors 16, 18 and a belt drive 20 seen only in FIG. 3, it being understood that the motors 16, 18 are mounted on the same rigid foundation, which may be a concrete pier 20, which supports the tower 10. There may be any number of wheels 14 as appropriate to the structure with the wheels being supported on concentric rails 19.

The tower 10 has downwardly sloping radial roof beams 21, to which plates may be attached to define a roof, and is divided vertically into a spaced series of superposed annular stories 22 through 38. Each story is subdivided about the vertical axis 15 of the tower into alternate, substantially radially extending storage regions 40, 42, each of the regions 40 being bounded on its sides by parallel frame members 43 and its ends by frame members 13 and 44 (FIG. 3) to define a substantially rectangular storage region for units, such as boats, of normal size, the alternate regions 42 between regions 40 being substantially triangular in plan to receive smaller boats or possibly supplies. On the lower story 22, at least one rectangular region 40*a* (FIG. 8) is especially adapted to receive a wheeled pallet 46 onto which a boat 48 may be deposited by lift means, described below, and the tower can then be rotated to a position where the pallet may be towed away by a car or tractor. The pallet 46 could be a conventional boat trailer.

Figure 8:
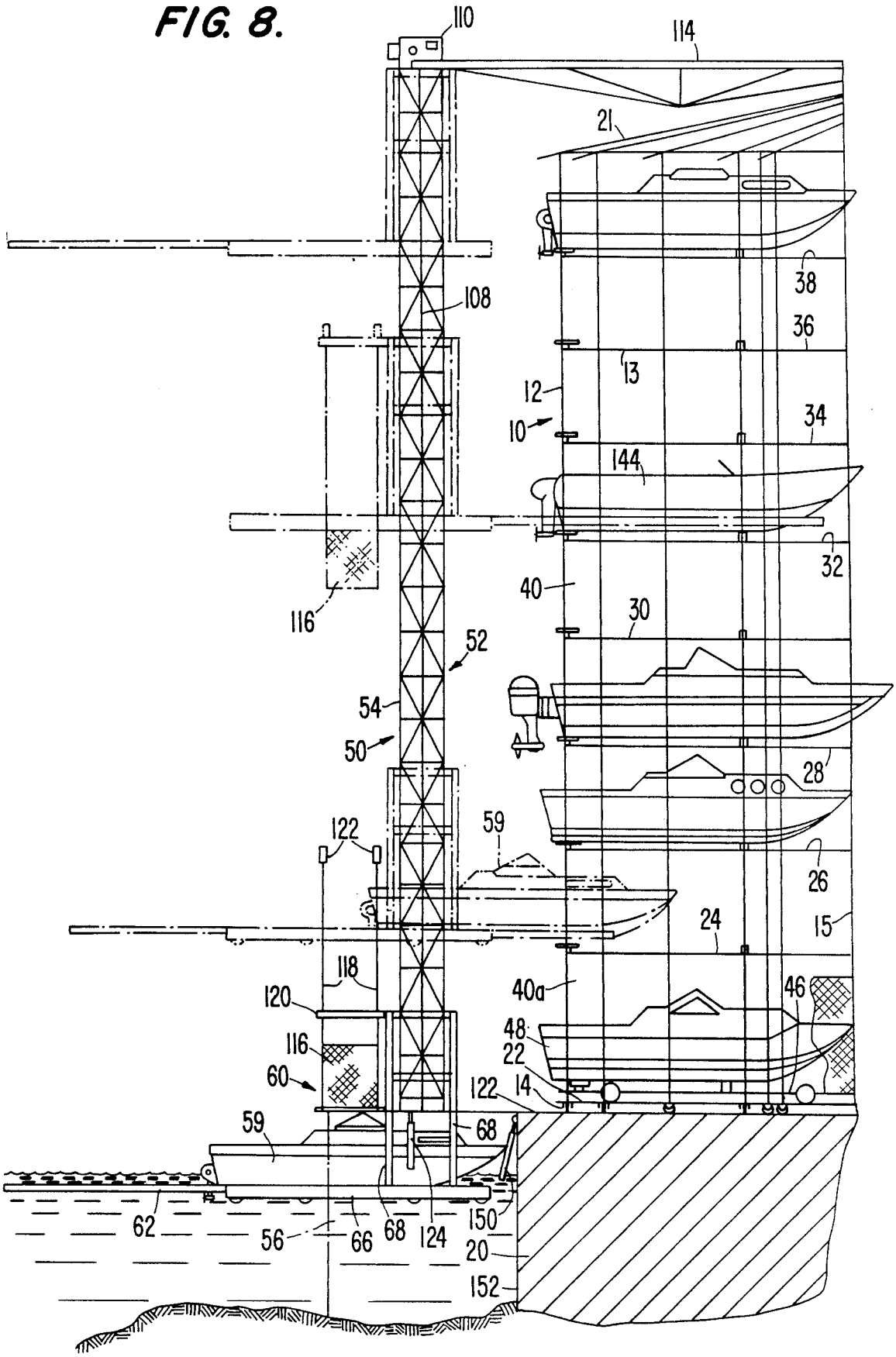
FIG. 8 is a partial, change position, side elevational view of the invention showing its manner of use.

As is evident in FIGS. 3 and 8, the radial outer end of each storage region 40, 42 opens to the exterior of the tower to receive units lifted thereto by elevator means broadly designated by the numeral 50. The elevator means includes a lift tower 52 which may be a frame structure composed of a pair of vertical support masts 54, 55, mounted on the pier 20 on opposite sides of a slip 56 in the pier 20 and adapted to receive a unit, such as a boat 59, which is to be raised or lowered by the elevator means. The elevator means also includes a lift car broadly designated by the numeral 60. The car 60 is movable vertically between a loading/unloading station at the bottom of the tower and any level corresponding to a selected story of the storage tower 10.

With reference now to FIGS. 4 through 7, the lift car includes pairs of fingers 62, 64, which are substantially radially oriented with respect to the vertical axis 15 of the storage tower. Means are carried by the lift car for moving the pairs of fingers laterally towards and away from each other to pick-up or release a unit at the loading/unloading station. The fingers are slideably mounted on beams 66 fixed to the lower ends of pairs of arcuate arms 68 whose upper ends 70 are pivoted to transverse frame members 72 best seen in FIG. 5.

The arms 68 of each pair are rigidly connected together by horizontal braces 74 (FIG. 7) and both pairs of arms are moved laterally in unison towards and away from each other by a nut 76 threaded on a shaft 78 driven by a reversible motor 80 to drive the nut upwardly or downwardly depending on the direction of rotation of the motor. Pivotally connected to the nut are the inner ends of links 82 whose outer ends are pivoted to the horizontal braces 74. It will be apparent that when a unit is to be lifted, say, from the loading/unloading station, the motor is operated to move the fingers 62, 64 apart far enough to permit the arms 68 to be lowered over the unit. Thereafter the motor is operated in the reverse direction to move the arms towards each other until the fingers engage the unit.

Means are also carried by the lift car for moving the fingers between a retracted position, wherein the fingers are clear of the storage tower, and an extended position wherein the fingers project from the lift car into a selected storage region to deposit or pick-up a unit therein. Each finger 62, 64, comprises an elongated beam having a length sufficient not only to engage a unit, but when extended, to be still firmly slideably supported on the lift car. The fingers carry on their outer faces channels 86 best seen in FIG. 6. These channels encompass rollers 88 having pivot shafts fixed to the beams 66. Also carried by the beams 66 are external rollers 90 having flanges 91 for engaging the inner faces of the fingers. For handling boats, the upper surfaces 92 of the fingers slope downwardly and inwardly as best seen in FIG. 6.

Figure 4:
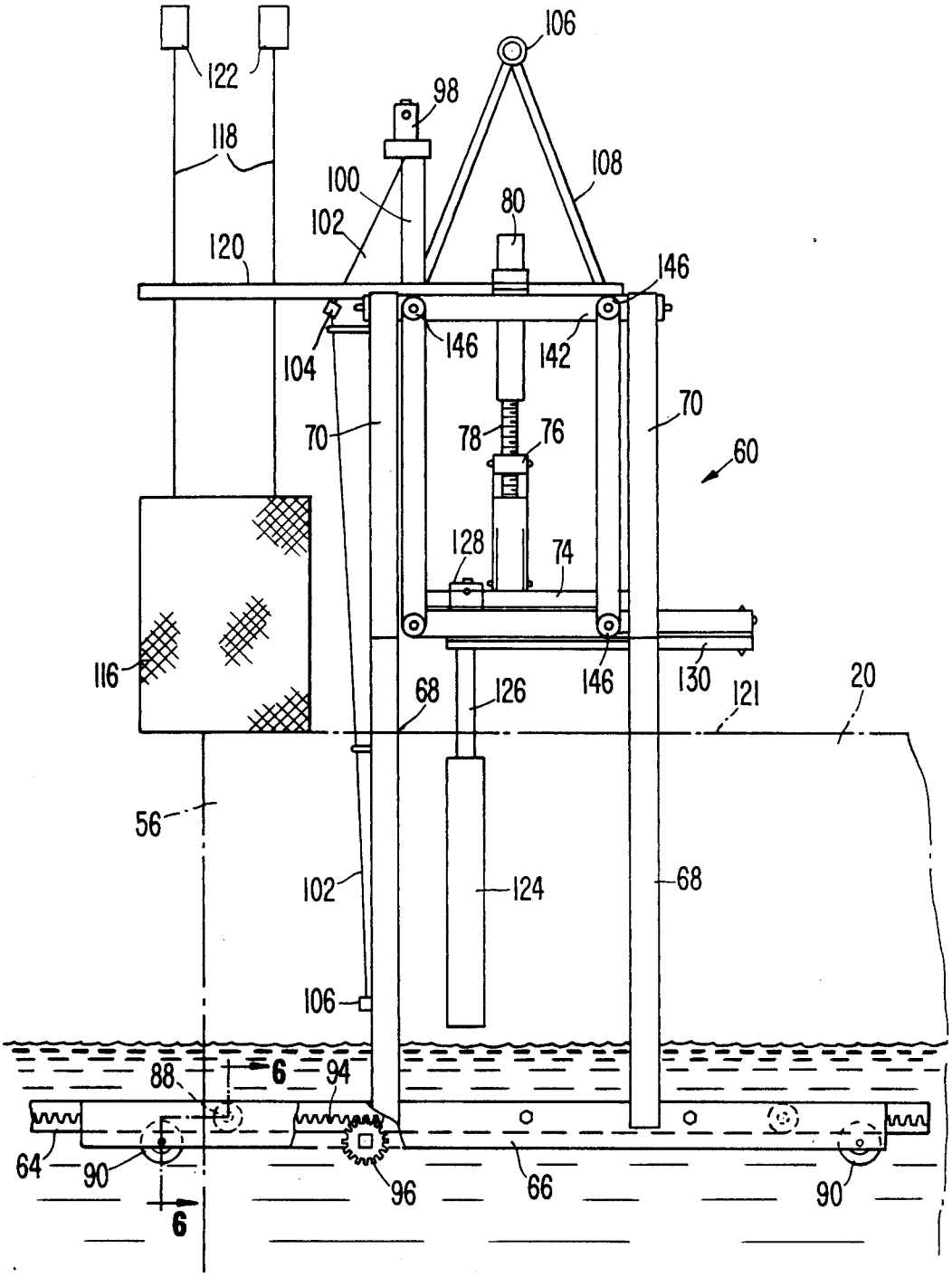
FIG. 4 is an enlarged side elevational view of a lift car in accordance with the invention.
Figure 6:
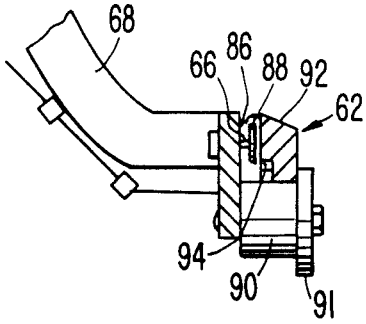
FIG. 6 is a broken, enlarged cross-sectional view taken substantially on the line 6-6 of FIG. 4.
Figure 5:
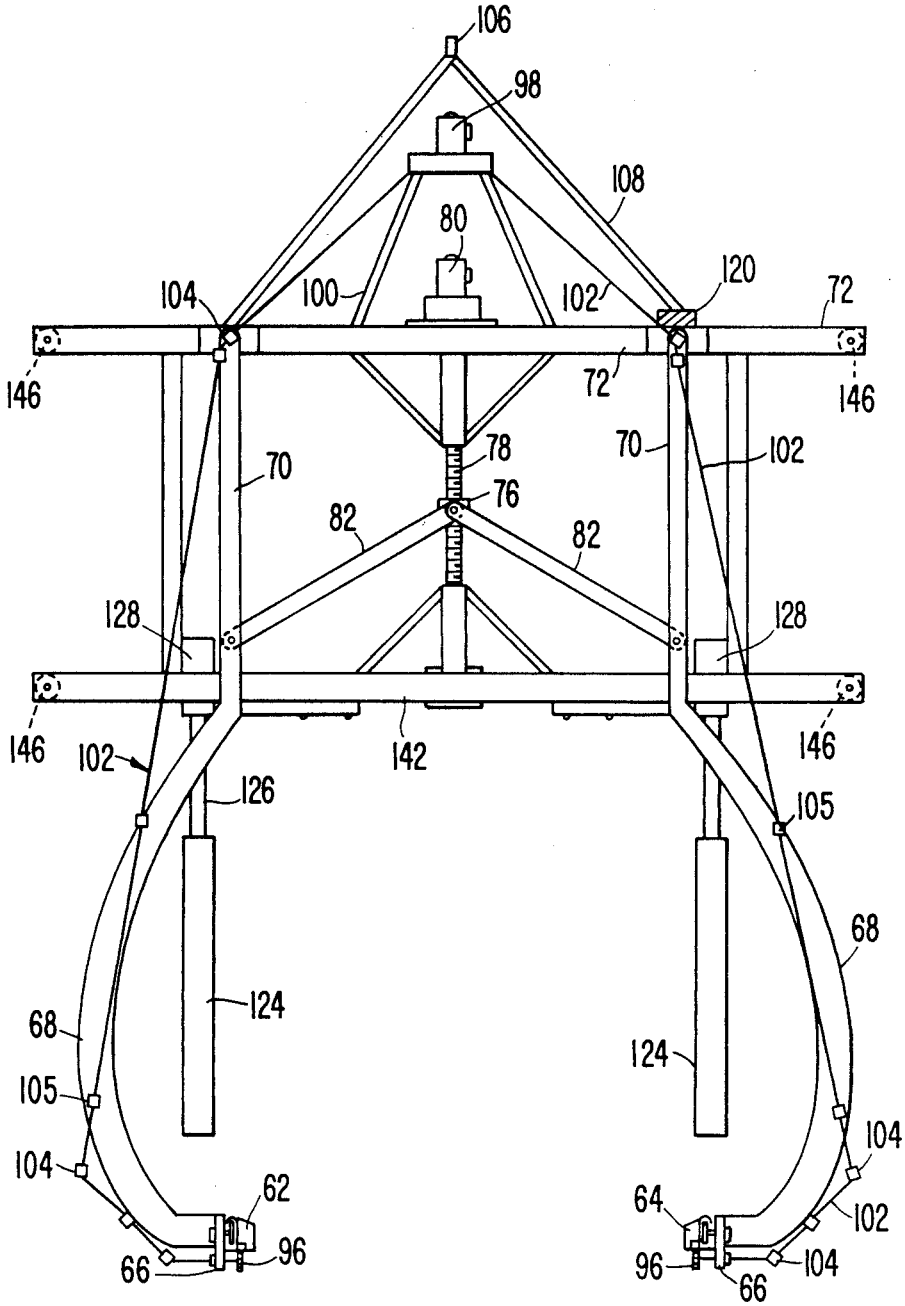
FIG. 5 is a front elevational view of the car of FIG. 4 with certain parts removed for purpose of clarity.

With reference now to FIGS. 5 and 6 it will be seen that each finger 62, 64 is longitudinally recessed to receive a toothed rack 94 engaged by a pinion 96 rotatably carried by each beam 66. The pinions are driven by a reversible motor 98 (FIG. 5) mounted on suitable framing 100 carried by the lift car. The motor 98 is operatively connected to the pinions 96 by suitable shafting generally designated by the numeral 102, and suitable universal joints and bearings generally designated by the numerals 104, 105. It will be apparent that when the motor 98 is driven in a direction to drive the pinion 96 counterclockwise in FIG. 4, the fingers 62, 64 will be retracted and when the motor drives the pinion clockwise the fingers will be extended.

The lift car, which as can be seen, is essentially of frame construction carries at its upper end an eye 106 connected by a frame or other suitable means 108 to the lift car, and to which may be connected a cable 108 leading to a reversible lift motor 110 carried by frame work 112 spanning the upper ends of the vertical tower masts 54, 55 as best seen in FIG. 2. The frame work 112 and the upper ends of the tower masts are also connected by booms 114 to the center of the upper end of the rotatable tower, it being understood that the ends of the booms remote from the lift tower have a pivotal connection with the upper end of the rotatable tower.

The lift car includes an operator's cage 116 carrying two or more vertical rods 118 slideable in apertures in a frame 120 (FIGS. 4 and 7) rigidly fixed to the car. When the facility of the invention is to be used for boat storage, the operator's cage 116 is positioned by the frame 120 such that when the lift car is lowered to its loading-/unloading station, the cage engages the surface 121 of the pier where the cage is stopped as the car continues downwardly relative to the now stationary rods 118 and cage 116. When the car is raised, the frame 120 slides upwardly on the rods 118 until it engages the lower faces of shock absorbers 122 whereupon the cage is picked-up for movement with the lift car with the operator being now positioned in an optimum position to see the bottom of a boat and ensure that the fingers are properly aligned with the opening of a selected storage region 40 or 42.

In accordance with the invention, where the facility is to be utilized for boat storage, the lift car is provided with a pair of flexible rotatable rollers 124. These rollers are movable laterally to engage the sides of the boats and are then rotated in one direction or the other to move the boat into a position to be lifted or to be moved away from the lift car after the boat has been lowered to a floating position in the slip 56.

Figure 7:
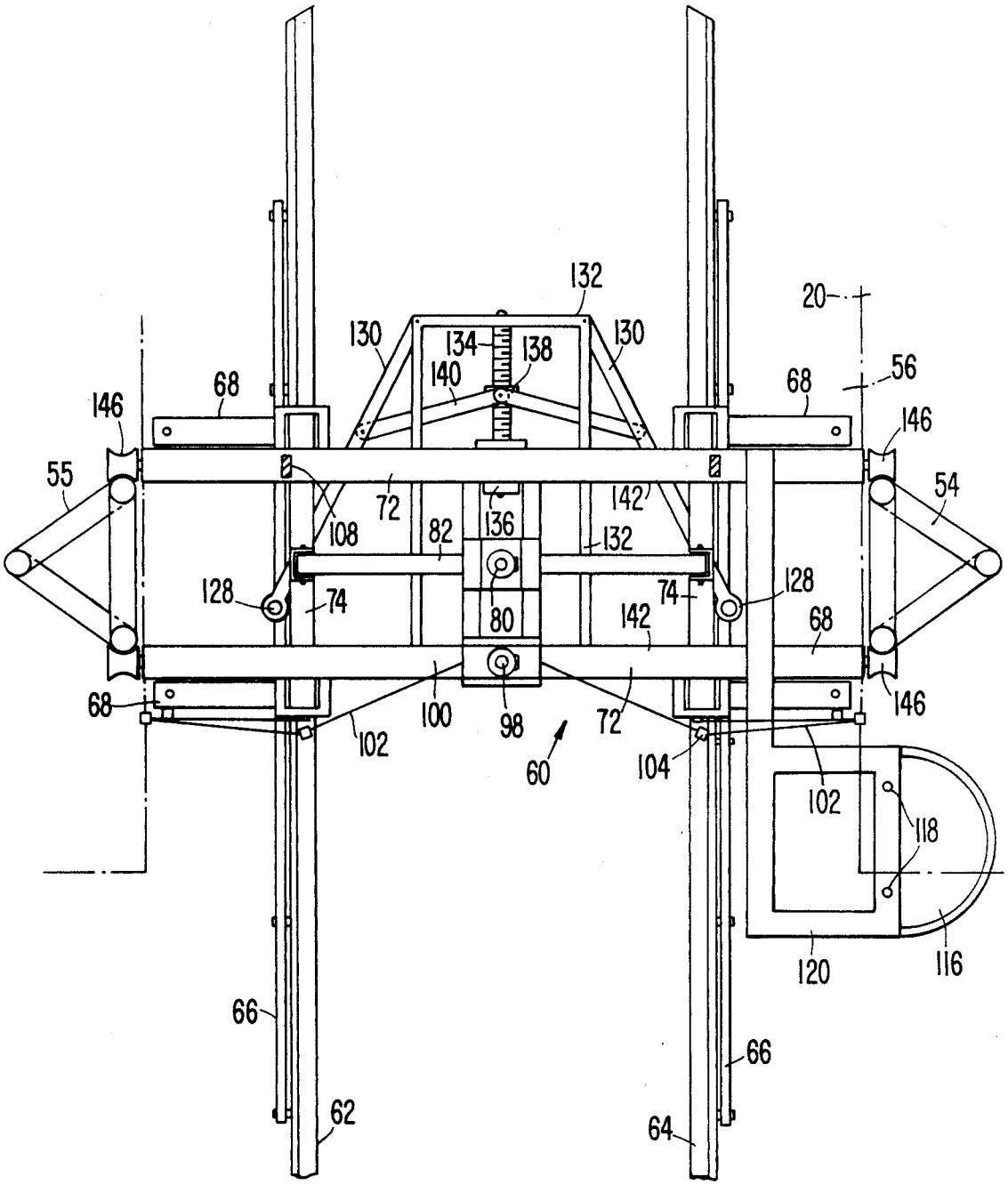
FIG. 7 is a top plan, partly broken, view of the car of FIG. 4.

As best seen in FIGS. 4, 5 and 7, the rollers 124 are carried by the shafts 126 of reversible electric motors 128 which in turn are connected to the outer ends of arms 130 (FIG. 7) whose inner ends are pivoted to a horizontal frame 132 rigidly fixed to the lift car frame. The frame 132 pivotally supports the outer end of a threaded shaft 134 those inner end is connected to a reversible motor 136. The shaft carries a nut 138 which is connected by links 140 to the arms 130. Rotation of the shaft 134 to move the nut 138 towards the motor 136 causes the links 140 to spread the arms 130, and to move the arms together when the motor 136 is operated in the reverse direction. The rollers 124 and motors 128 can be light since the rollers need not have any more than rubbing engagement with a boat to move it in one direction or the other and to center it over the fingers. It will be apparent, however, that after a boat has been moved generally into the vicinity of the lift car, within the slip 56, the operator adjusts the spacing of the rollers 124 to conform to the width of the boat by operation of the motor 136, thereby centering the boat in the slip, and then operates the motors 128 in the appropriate direction to move the boat clear of the lift car or further into the slip 56 until the boat is properly positioned over the fingers.

It will be noted in FIGS. 5 and 7, that the ends of the upper frame members 72 and lower frame members 142, of the lift car carry arcuate rollers 146 which engage the outer curved surfaces of inner components of the vertical the lift tower masts 54, 55 as best seen in FIG. 7, the masts being omitted in FIG. 5.

The operation of the storage facility should be clear from FIG. 8. Let it be assumed that the boat 59 is to be lifted for storage at the level 24. First, the lift car is lowered to the loading/unloading station of FIG. 8. If the boat is already in the slip 56, the operator from the cage 116 operates controls to energize motor 80 in a direction to spread the finger arms 68 sufficiently far apart that the fingers can be lowered over the boat to a position below, or at least partly below, the bottom of the boat. At this point, the fingers are in their fully retracted position as shown at the bottom of FIG. 8.

The operator then operates the motor 136 (FIG. 7) to move vertical rollers 124 (FIG. 5) laterally to engage the sides of the boat and center it laterally over the fingers; he may then operate the motors 128 (FIG. 5) to rotate the rollers 124 about their vertical axes to adjust the boat longitudinally over the fingers. The end wall of the slip is desirably provided with a pair of fenders 150 arranged in a V-shape for engagement by the bow of the boat to prevent its colliding with the end wall 152 of the slip 56.

Thereafter the operator moves the fingers towards each other by operation of the motor 98 (FIG. 5) until the fingers are properly positioned beneath the boat whereupon he energizes the lift motor 110 located at the top of the lift tower (FIG. 8) to raise the boat to a preselected level, say level 24, known to have an empty storage region. The operator then operates the controls (not shown) available to him in the lift cage and effects rotation of the storage tower. It is within the skill of the art either by the use of computers or suitable electromechanical relays and switches to cause the tower to rotate automatically in the direction which is closest to the lift tower and then to stop with the desired storage region in alignment with the fingers, but even if such are not supplied it is within the ability of an operator by sight alone to rotate the tower in the appropriate direction until the selected storage region is aligned with the fingers, whereupon the operator actuates the controls to extend the fingers until the boat is properly inside the storage region. The operator then lowers the car slightly until the boat rests on pre-positioned supports in the storage region exactly as boats are now supported in the linear boat storage facilities described above, and retracts the fingers.

When the car is moved to a second position, say level 32, for boat pick-up, the operator elevates the lift car to that level, extends the fingers beneath boat 144, elevates the lift car a slight distance more to lift the boat clear of its supports, retracts the fingers with the boat thereon and then lowers the lift car to the loading/unloading station at the bottom of the tower in FIG. 8, adjusting the lateral spacing of the vertical rollers 124, if necessary, and thereafter actuating the roller motors 128 to rotate the rollers 124 (FIG. 5) in the proper direction to move the boat out of the slip 56.

I claim:

1. A storage facility for individually movable units comprising a cylindrical storage tower formed as a rotatable structure having a spaced series of superposed annular stories each sub-divided into circumferentially spaced, substantially radial storage regions of sizes to receive said units, each region having an outer end opening to the exterior of said storage tower, and elevator means including a lift tower fixed in close spaced adjacency to the exterior of said storage tower, and a lift car movable vertically on said lift tower between a loading/unloading station at the bottom of said lift tower and any level corresponding to a selected story of said storage tower, said lift car including a pair of laterally spaced movable fingers substantially radially arranged with respect to the vertical axis of said cylindrical storage tower, means carried by said lift car for moving said fingers between a retracted position wherein said fingers are clear of said storage tower and an extended position wherein said fingers project from said lift car into a selected storage region to deposit or pickup a unit therein, and power means for rotating said storage tower to a position wherein the open end of said selected storage region is in radial alignment with said lift tower.

2. The storage facility of claim 1 including means carried by said lift car for adjusting the spacing between said fingers laterally towards or away from each other for picking up or releasing a unit at said loading/unloading station.

3. The storage facility of claim 2 wherein said lateral adjusting means comprise a pair of substantially vertical arm means having lower and upper ends, means carried by the lower ends of said arm means for slideably supporting said fingers, the upper ends of said arms means being pivotally connected to said lift car, and means operatively connected to said arm means intermediate their ends for moving said arm means in unison laterally towards and away from each other.

4. The storage facility of claim 1 including a boat slip at said loading/unloading station of a size to receive boats capable of being stored in the storage regions of said rotatable tower, a pair of laterally spaced, substantially vertical rollers carried by said lift car, means for adjusting the spacing between said rollers laterally towards or away from each other for engagement with the sides of a boat in said slip to center said boat with respect to said fingers, and means for rotating said rollers simultaneously in either direction to position said boat longitudinally with respect to said fingers.

5. The storage facility of claim 4 including an operator's cage carried by said lift car, means slideably connecting said cage to said car, stop means positioned adjacent said slip and engageable by said cage to stop said cage while permitting said car to descend to the loading/unloading stations and means carried by said slideable connecting means in a position to be engaged by said car after it has been elevated to a predetermined position relative to said cage to lift said cage from said stop means for movement thereafter with said lift car.

* * * * *